US006803511B2

(12) United States Patent
Mizuno

(10) Patent No.: US 6,803,511 B2
(45) Date of Patent: Oct. 12, 2004

(54) ELECTRONIC MUSIC APPARATUS CAPABLE OF CONNECTING TO COMMUNICATION NETWORK

(75) Inventor: Shigehiko Mizuno, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/345,606

(22) Filed: Jan. 15, 2003

(65) Prior Publication Data

US 2003/0136247 A1 Jul. 24, 2003

(30) Foreign Application Priority Data

Jan. 18, 2002 (JP) ..... 2002-009522

(51) Int. Cl.[7] ..... G10H 7/00
(52) U.S. Cl. ..... 84/600
(58) Field of Search ..... 84/600–602, 645

(56) References Cited

U.S. PATENT DOCUMENTS 5,664,107 A * 9/1997 Chatwani et al. ..... 709/224
6,345,294 B1 * 2/2002 O'Toole et al. ..... 709/222
6,369,310 B1 4/2002 Brunson et al.

* cited by examiner

*Primary Examiner*—Jeffrey W Donels
(74) *Attorney, Agent, or Firm*—Morrison & Foerster LLP

(57) ABSTRACT

An electronic music apparatus comprises a transmitter that transmits an acquiring request for information about a network configuration to a server via a communication network, a receiver that receives the information about a network configuration from the server, and a setting device that sets up a network configuration of the communication network in accordance with the received information about a network configuration. A network configuration is easily set up.

8 Claims, 5 Drawing Sheets

ELECTRONIC MUSIC APPARATUS CAPABLE OF CONNECTING TO COMMUNICATION NETWORK

CROSS REFERENCE TO RELATED APPLICATION

This application is based on Japanese Patent Application 2001-009522, filed on Jan. 18, 2002, the entire contents of which are incorporated herein by reference.

BACKGROUND OF THE INVENTION

A) Field of the Invention

This invention relates to an electronic music apparatus, and more in detail, relates to an electronic music apparatus that can make a network connection.

B) Description of the Related Art

Conventionally, there is an electronic music apparatus such as an electronic music instrument or the like which can connect to a local area network (LAN) and a wide area network (WAN) such as the Internet.

In the network communication, for example, a protocol such as Transmission Control Protocol/Internet Protocol (TCP/IP) is used for making network communications among each node (electronic music apparatus).

In the network communication based on the TCP/IP, for example, an IP packet consisted of an IP header of 20 bytes in a top part and a data part of maximum 64 Kbytes after the IP header is used.

An IP header part is consisted of a receiver IP address and transmitter IP address, a data length, a type of a higher level protocol (TCP, UDP, etc.), various flags, a check sum, a Time To Live (TTL) value, etc.

The receiver IP address of the IP header part was necessary to be set manually by a user to make a network communication with the TCP/IP in the conventional electronic music apparatus. Also, at the same time, a gateway. address, a domain name, a subnet mask, and other information are necessary to be set on the electronic music apparatus by which the user is about to make network a connection. In this specification, these settings are called just a network configuration.

The above described network configurations are complicated and difficult to be set manually by a user who is unskilled to the network configuration. Especially, in the setting of the IP address or the like, a term is difficult to be understood, and there are many users who do not know what kind of value to be set.

Also, in the case that a common value is necessary to be set in the network, it is intricate to set the common value in all of the electronic music apparatuses in the network manually.

Moreover, in the network of the conventional electronic music apparatuses, it was difficult to prevent illegal or unauthorized accesses to the network.

SUMMARY OF THE INVENTION

It is an object of the present invention to provide an electronic music apparatus wherein a network configuration is easily set.

It is another object of the present invention to provide an electronic music apparatus the can prevent illegal or unauthorized accesses to a network of a plurality of electronic music apparatuses.

According to one aspect of the present invention, there is provided an electronic music apparatus comprising a transmitter that transmits an acquiring request for information about a network configuration to a server via a communication network, a receiver that receives the information about a network configuration from the server, and a setting device that sets up a network configuration of the communication network in accordance with the received information about a network configuration.

According to another aspect of the present invention, there is provided an electronic music apparatus comprising a receiver that receives an acquiring request for information about a network configuration from a client via a communication network, a generating device that generates information about a network configuration for supplying to the client in accordance with the received acquiring request for the information about a network configuration, and a transmitter that transmits the generated information about a network configuration to the client.

According to further aspect of the present invention, there is provided an electronic music apparatus comprising a first receiver that receives identifying information for identifying a server from the server via a communication network, an authorizing device that authorizes or rejects an access from the server based on the identifying information for identifying the server, a second receiver that receives operating information for a setting or a file operation from the server when the authorizing device authorizes the access from the server, and a operating device that operates the setting or the file operation in accordance with the received operating information.

According to the present invention, the network configuration can be set easily.

Also, according to the present invention, illegal or unauthorized accesses to the network of the plurality of the electronic music apparatuses can be prevented.

DETAILED DESCRIPTION OF THE PREFERRED EMBODIMENTS

Figure 1:
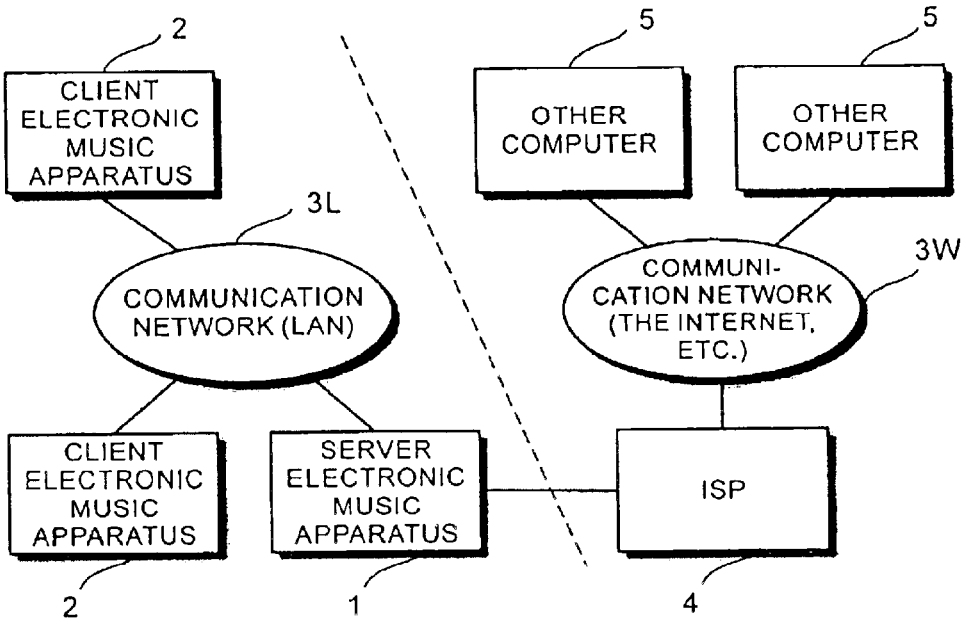
FIG. 1 is a schematic view of a communication network according to an embodiment of the present invention.

FIG. 1 is a schematic view of a communication network according to an embodiment of the present invention. In the drawing, on a left side of a broken line, a local area network (LAN) using a private IP address is shown, and a right side of the broken line, a wide area network (WAN) such as the Internet using a global IP address.

In the LAN, a server electronic music apparatus 1 and a plurality of client electronic music apparatuses 2 are connected via a communication network (LAN) 3L. In the WAN, an Internet service provider (ISP) 4 that provides a service for connecting the server electronic music apparatus 1 with devices on the WAN and a plurality of other computers such as Web servers, etc. are connected to each another via a communication network (the Internet, etc.) 3W.

In the server electronic music apparatus 1, a private IP address (for example, "192.168.0.1", etc.) is assigned as a default value. A global IP address other than the default private IP address is assigned by the ISP 4.

In the LAN, each client electronic music apparatus 2 and the server music electronic music apparatus 1 communicate with each other by using the private IP addresses, and in the WAN, each of other computers 5 and the ISP 4 communicate with each another by using the global IP addresses. Also, the server electronic music apparatus 1 communicates with the ISP 4 by using the global IP addresses.

Moreover, the server electronic music apparatus 1 assigns the private IP address to each client electronic music apparatus 2 connected to the network 3L in the LAN by a later-described IP address assigning process shown in FIG. 3.

The server electronic music apparatus 1 converts the private IP address of each client electronic music apparatus 2 to the global IP address assigned by the ISP 4. The conversion from the private IP address to the global IP address is, for example, executed by the so-called IP masquerade.

As described above, since the server electronic music apparatus 1 converts the private IP addresses in the LAN to the global IP address, a mutual access between the client electronic music apparatuses 2 and the apparatuses in the WAN becomes possible.

Figure 2:
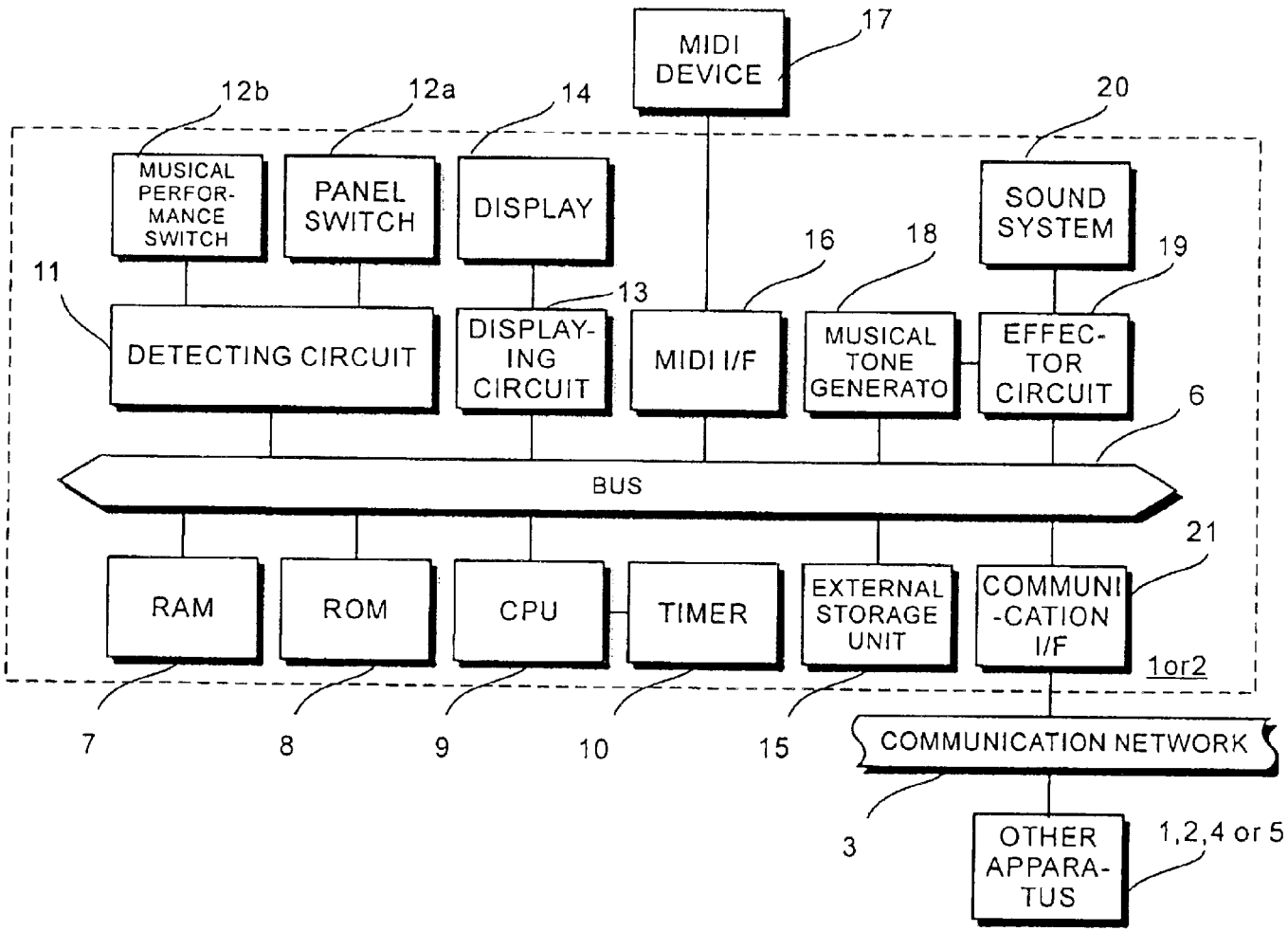
FIG. 2 is a block diagram showing a hardware structure of a server electronic music apparatus 1 or a client electronic music apparatus 2 according to the embodiment of the present invention.

FIG. 2 is a block diagram showing a hardware structure of the server electronic music apparatus 1 or the client electronic music apparatus 2 according to the embodiment of the present invention.

The server electronic music apparatus 1 (the client electronic music apparatus 2) is consisted of a bus 6, a RAM 7, a ROM 8, a CPU 9, a timer 10, a detecting circuit 11, a panel switch 12*a*, a performing switch 12*b*, a display circuit 13, a display 14, an external storage unit 15, a MIDI interface 16, a musical tone generator 18, an effecter circuit 19, a sound system 20 and a communication interface (I/F) 21.

The RAM 7, the ROM 8, the CPU9, the external storage unit 15, the detecting circuit 11, the display circuit 13, the MIDI interface 16, the musical tone generator 18, the effecter circuit 19 and the communication interface (I/F) 21 are connected to the bus 6.

The RAM 7 has a working area of the CPU 9 that stores a register or a buffer and various kinds of parameters or the like. The various kinds of parameters and a control program, or a program for achieving the embodiment of the present invention can be stored in the ROM 8. In this case, it is not necessary to store the programs, etc. in the external storage unit 15.

In the ROM 8, a unique electronic music apparatus identifying information for each server electronic music apparatus 1 or each client electronic music apparatus 2 is stored. The electronic music apparatus identifying information is information containing: a device ID by which an electronic music apparatus is identified unambiguously and a type of the electronic music apparatus is specified; and a device name such as a product name or a nickname. Moreover, in this embodiment, any apparatuses having the electronic music apparatus identifying information are called electronic music apparatuses, and other apparatuses are called non-electronic music apparatuses.

CPU 9 performs calculations or controls in accordance with the control programs stored in ROM 8 or external storage unit 15. The timer 10 connected to CPU 9 supplies CPU 9 with a main clock signal, interrupt timing and the like.

A user can set up various settings by using the panel switch 12*a* connected to the detecting circuit 11. The panel switch 12*a* may be anything that can output a signal in accordance with an input operation of the user such as, for example, a switch, a pad, a fader, a slider, an alphanumerical keyboard, a mouse, a rotary encoder, a joystick, a jog shuttle, etc.

Also, the panel switch 12*a* may be a software-switch that is displayed on the display 14 and manipulated by other switch such as a mouse, etc.

The musical performance switch 12*b* connected to the detecting circuit 11 supplies a performance signal in accordance with a musical performance of the user. A musical keyboard, a pad, etc. can be used as the musical performance switch 12*b*. Further, as the musical performance switch 12*b*, anything for inputting performance information may be used. For example, an alphanumerical keyboard, a mouse, a joystick or the like can be used as the musical performance switch 12*b*. Moreover, the musical performance switch 12*b* can be omitted when the server electronic music apparatus 1 or the client electronic music apparatus 2 is a mixer or a musical tone generator.

The displaying circuit 13 connected to the display 14 displays various information on the display 14. The user inputs various information and sets up various settings with reference to the information displayed on the display 14. Also, the display 14 may be consisted of an external display connected to the displaying circuit 13.

Moreover, a touch-panel may be used as the display 14. In this case, an instruction of the user is input by pushing a switch, etc. displayed on the display 14.

The external storage unit 15 has an interface and is connected via the interface to the bus 11. The external storage unit 15 may be a floppy (trademark) disk drive (FDD), a hard disk drive (HDD), a magneto optical disk (MO) drive, a compact disc read-only memory (CD-ROM) drive, a digital versatile disc (DVD) drive, a semiconductor memory or the like.

The control programs, program realizing the embodiment functions and the like may be stored in a hard disk (HDD) of the external storage unit 15. By reading the control programs and the like from the HDD to RAM 7, CPU 9 can perform operations similar to those when the control programs and the like are stored in ROM 8. In this case, addition, version-up and the like of the control programs and the like can be made easy.

The control programs, program for realizing the embodiment functions and the like may be stored in a CD-ROM. The control programs, program for realizing the embodiment functions and the like can be copied from CD-ROM to the HDD. In this case, addition, version-up and the like of the control programs and the like can be made easy.

The MIDI interface (MIDI I/F) 16 is used for connection to other musical instruments, audio apparatuses, computers or the like, and can transmit/receive at least MIDI signals. The MIDI interface 16 is not limited only to a dedicated MIDI interface, but it may be other general interfaces such as RS-232C, universal serial bus (USB) and IEEE1394. In this case, data other than MIDI message data may be transmitted/received at the same time.

The MIDI device 17 is an audio apparatus, musical instrument or the like connected to the MIDI interface 16.

The type of the MIDI device is not limited only to a keyed instrument, but other types may also be used such as a stringed instrument, a wind instrument and a percussion instrument. The MIDI device 17 is not limited only to an electronic musical instrument of the type that the components thereof such as a tone generator and an automatic performance apparatus are all built in one integrated body, but these components may be discrete and interconnected by communication devices such as MIDI and various networks. The user can also use the MIDI device 17 as the musical performance switch 12*b* to input performance information.

In addition, the MIDI device 17 can be used as the panel switch 12*a* for inputting various data other than performance information and various settings.

The musical tone generator 18 generates tone signals in accordance with music data stored in the external storage unit 15, ROM 8 or the RAM 7 or performance signals, MIDI signals or the like supplied from the musical performance switch 12*b* or the MIDI device 17 connected to the MIDI interface 16, and supplies the generated tone signals to a sound system 20 via the effecter circuit 19.

The effecter circuit 19 adds various musical effects to the tone signals supplied from the musical tone generator 18.

The sound system 20 includes a D/A converter and speakers, and converts supplied digital tone signals into analog tone signals to produce sounds.

The musical tone generator 18 may be of any type, such as a waveform memory type, an FM type, a physical model type, a harmonics synthesis type, a formant synthesis type, and an analog synthesizer type having a voltage controlled oscillator (VCO)+a voltage controlled filter (VCF)+a voltage controlled amplifier (VCA).

The musical tone generator 18 is not limited only to those made of hardware, but may be realized by a digital signal processor (DSP) and a micro program, by a CPU and a software program, or by a sound card.

One musical tone generator may be used time divisionally to form a plurality of sound producing channels. or a plurality of musical tone generators may be used to form a plurality of sound producing channels by using one musical tone generator per one sound producing channel.

The communication interface 21 can connect to the communication network 3 such as a local area network (LAN), the Internet, a phone line or the like, and can mutually connected with other apparatus 2, 4 or 5 via the communication network 3.

Further, the communication interface 21 and the communication network 3 are not limited to be wired but also be wireless or both wired and wireless. Also, the communication interface 21 may be a built-in type (assembled in the server electronic music apparatus 1 or the client electronic music apparatus 2) or a removable type such as a PC card, etc.

Figure 3:
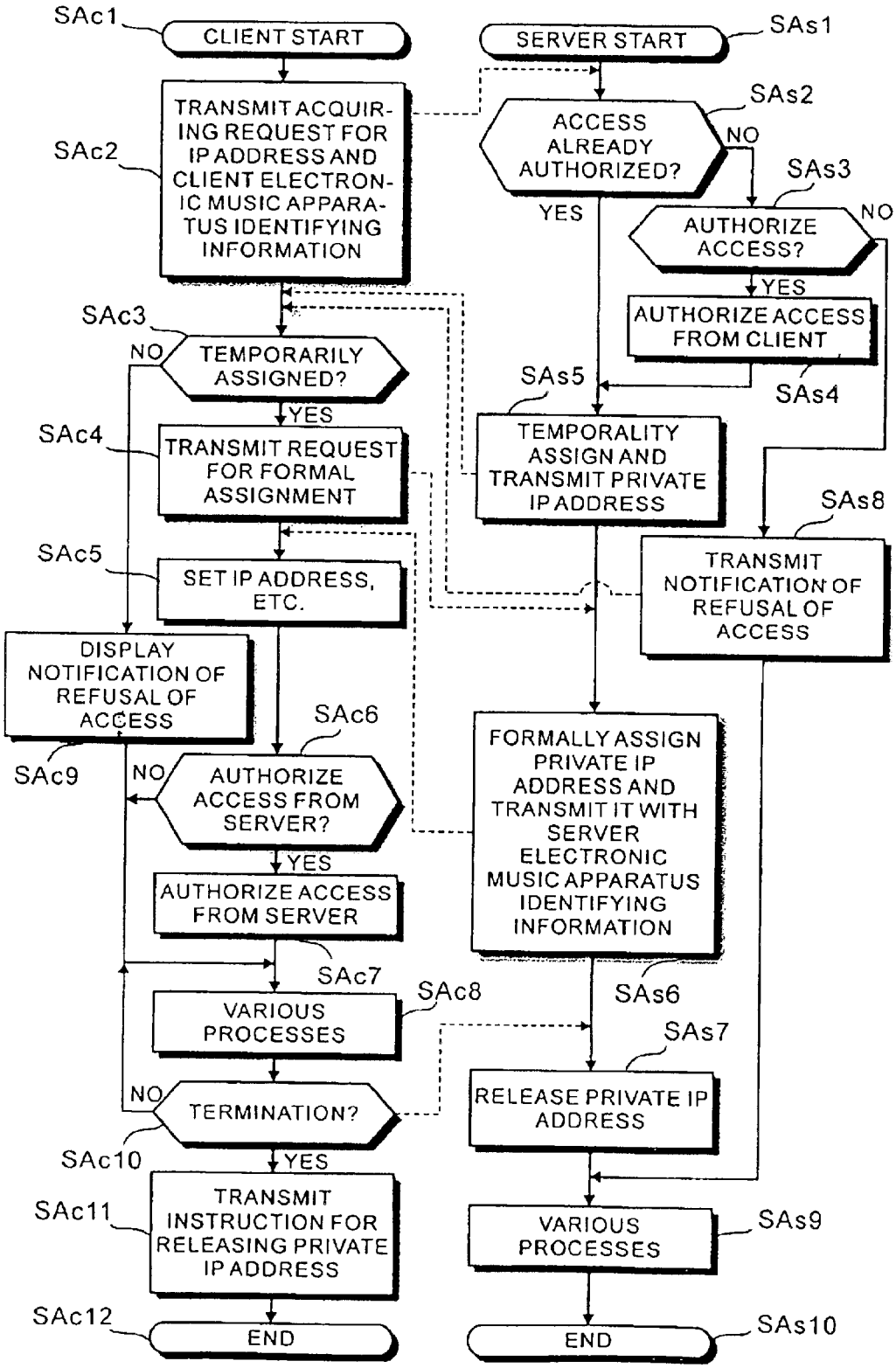
FIG. 3 is a flow chart showing an IP address assigning process according to the embodiment of the present invention.

FIG. 3 is a flow chart showing an IP address assigning process according to the embodiment of the present invention. In the drawing, the broken lines represent flows of data. Step SAc1 to Step SAc12 represent a process executed by the client electronic music apparatus 1 shown in FIG. 1 (hereinafter called "the client"), and Step SAs1 to Step SAs10 represent a process executed by the server electronic music apparatus 2 shown in FIG. 1 (hereinafter called "the server").

At Step SAc1, the client-side process is started and the process proceeds to Step SAc2.

At Step SAc2, an acquiring request for an IP address and client electronic music apparatus identifying information are transmitted to the server. Thereafter the process proceeds to Step SAc3.

At Step SAc3, whether an IP address is assigned by the server or not is judged. When the IP address is assigned, that is, when a temporally IP address transmitted at later-described Step SAs5 is received, the process proceeds to Step SAc4 as directed by an arrow marked "YES". When the IP address is not assigned, that is, when a notification of refusal of the access transmitted at later-described Step SAs8 is received, the process proceeds to Step SAc9 as directed by an arrow marked "NO", a message notifying the refusal of the access is displayed at Step SAc9, and then the process proceeds to Step SAc10.

At Step SAc4, an assignment of a formal private IP address is requested to the server. Thereafter the process proceeds to Step SAc5.

At Step SAc5, information for a network configuration including a formal private IP address, etc. transmitted at later-described Step SAs6 and a server electronic music apparatus identifying information for identifying a server electronic music apparatus are received, and the network configuration is executed. Thereafter, the process proceeds to Step SAc6.

At Step SAc6, whether the access from the server is authorized or not is judged. The access from the server is a network connection from the server to make a setting of the client and execute a file operation on the client side. Also, this authorization step is executed in accordance with the server electronic music apparatus identifying information received at Step SAc5. The server electronic music apparatus identifying information of the server of which the access to the client is authorized is stored in the client beforehand, or whether the access from the server is authorized or not may be inquired to the user at every time the server assigns the private IP address. Furthermore, the access from the server may be authorized without any conditions. When the access from the server is authorized, the process proceeds to Step SAc7 as directed by an arrow marked "YES". When the access from the server is refused, for example, when the client is participating to a LAN of the other person or the other LAN, and the user does not want the other person to control the network configuration and files, the process proceeds to Step SAc8 as directed by an arrow marked "NO".

At Step SAc7, the access from the server is authorized, and the process proceeds to Step SAc8.

At Step SAc8, various other processes are executed. The other processes are processes for executing unique functions of each electronic music apparatus such as, for example, reproduction, edition, and recording of automatic performance data (music data), a musical performance of the user, etc. Thereafter the process proceeds to Step SAc10.

At Step SAc10, whether there is an instruction from the user to terminate the IP address assigning process or not is judged. When the termination of the process is instructed, the process proceeds to Step SAc11 as directed by an arrow marked "YES". When the termination of the process is not instructed, the process returns to Step SAc8 as directed by an arrow marked "NO".

At Step SAc11, release of the assigned private IP address is instructed to the server. Then, the process proceeds to the next Step SAc12, and the IP address assigning process is terminated.

The sever-side process is explained below.

At Step SAs1, the server-side IP address assigning process is started, and the process proceeds to the next Step SAs2.

At Step SAs2, the acquiring request for an IP address and the client electronic music apparatus identifying information transmitted at Step SAc2 are received, and whether an access from the client having the received client electronic music apparatus identifying information has already authorized or not is judged. When the access from the client has already authorized, the process proceeds to Step SAs5 as directed by an arrow marked "YES". When the access from the client has not authorized yet, the process proceeds to Step SAs3 as directed by an arrow marked "NO".

At Step SAs3, whether the access from the client is authorized or not is judged. This authorization process is executed in accordance with the client electronic music apparatus identifying information received at Step SAs2. The client electronic music apparatus identifying information of the client of which the access to the server is authorized is stored in the server beforehand, or whether the access from the server is authorized or not may be inquired to the user of the server at every time the client accesses to the server. Furthermore, the access from the client may be authorized without any conditions. When the access from the client is authorized, the process proceeds to Step SAs4 as directed by an arrow marked "YES". When the access from the client is refused, the process proceeds to Step SAs8 as directed by an arrow marked "NO". the notification of the refusal of the access is transmitted to the client at Step SAs8, and then the process proceeds to Step SAs9.

At Step SAs4, the access from the client is authorized, and the process proceeds to Step SAs5.

At Step SAs5, one of unused private IP addresses is temporarily assigned to the client that transmitted the acquiring request for an IP address, and information for a network configuration including the temporarily assigned private IP address is transmitted to the client. Then, the process proceeds to Step SAs6.

At Step SAs6, the acquiring request for a formal private IP address is received from the client, and a formal private IP address is assigned to the client. In addition to that, the server electronic music apparatus identifying information is transmitted to the client together with the formally assigned private IP address. Then, the process proceeds to Step SAs7.

At Step SAs7, the private IP address releasing request transmitted from the client at Step SAc11 is received, and the private IP address once assigned to the client is released for preparing to assign it to other client. Then the process proceeds to Step SAs9.

At Step SAs9, other processes are executed, and the process proceeds to Step SAs10 to terminate the server-side IP address assigning process. The server-side IP address assigning process is always executed repeatedly when the server is turned on.

Figure 4:
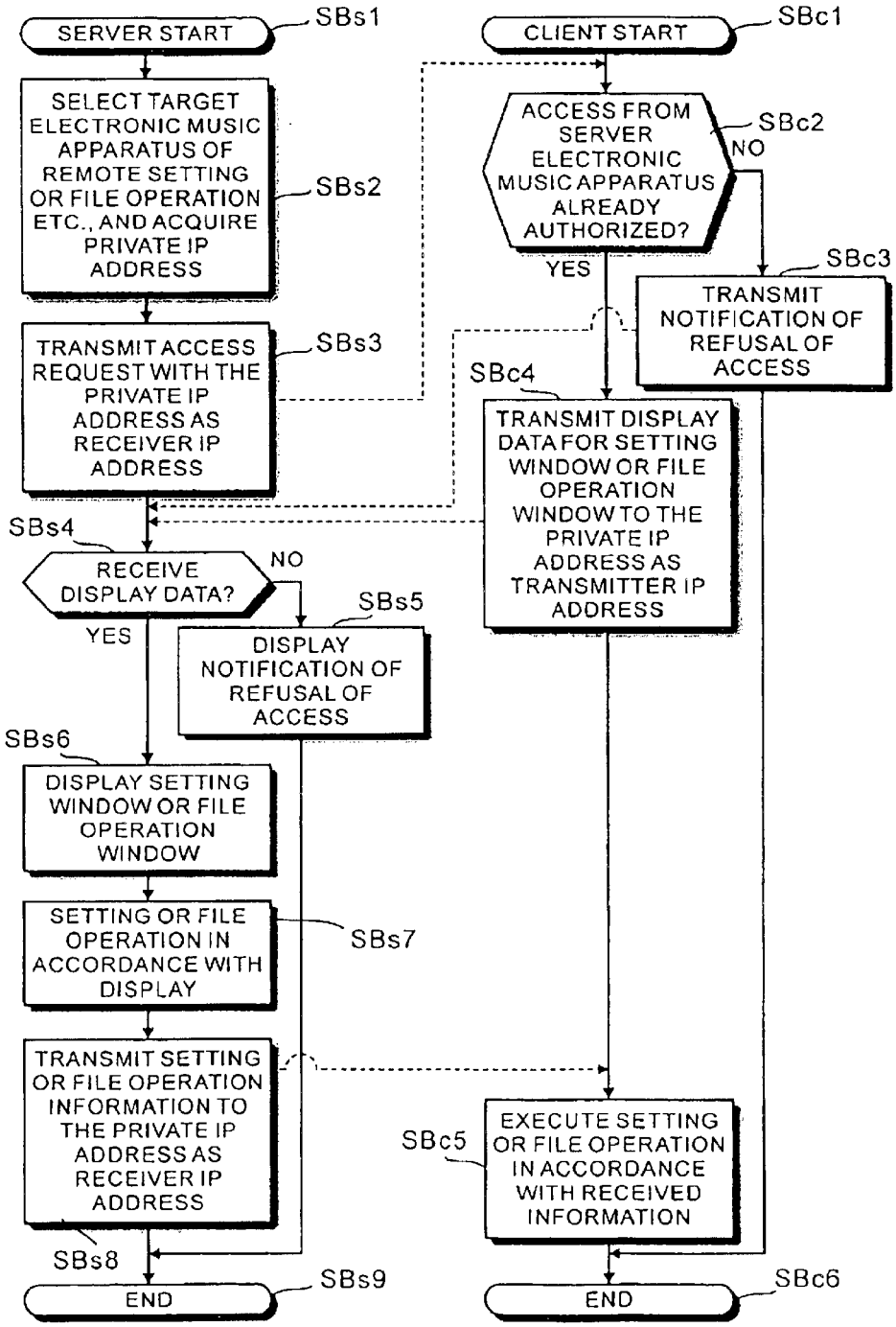
FIG. 4 is a flow chart showing a client-setting process according to the embodiment of the present invention.
Figure 5:
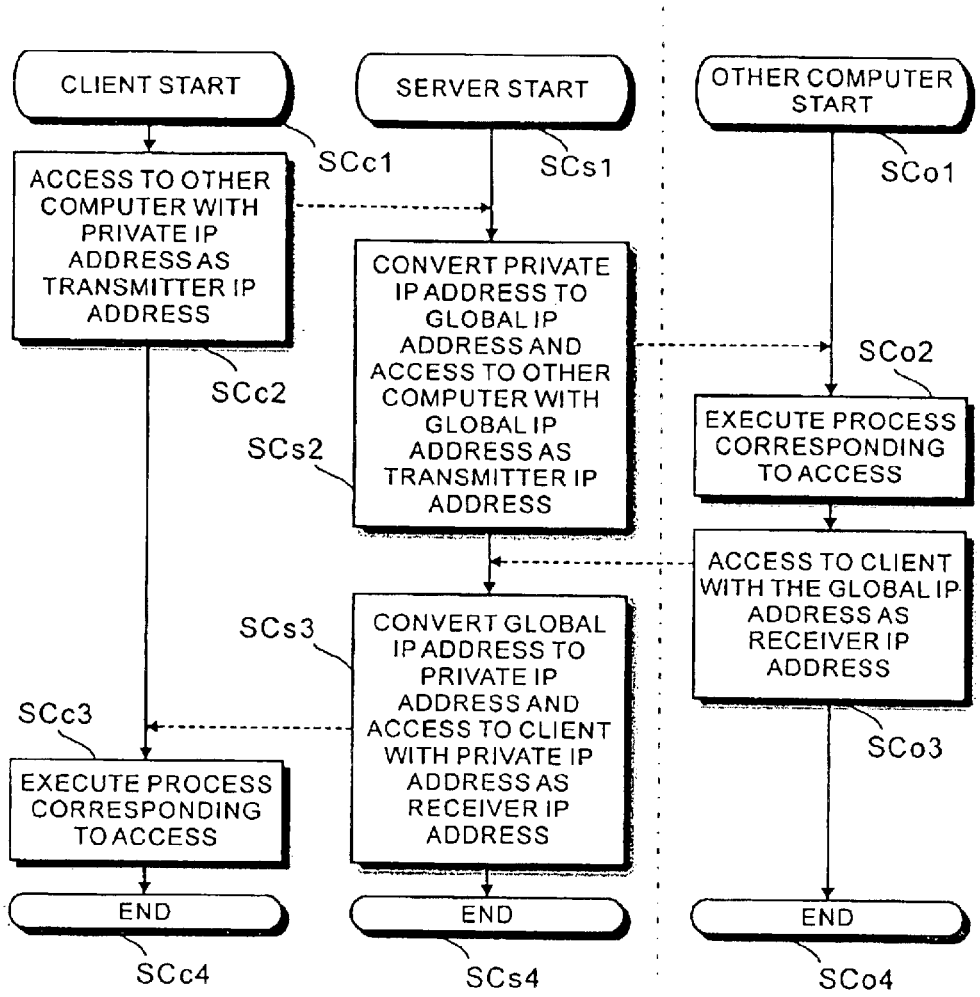
FIG. 5 is a flow chart showing an IP address converting process according to the present invention.

FIG. 4 is a flow chart showing a client setting process according to the embodiment of the present invention. In the drawing, the broken lines represent flows of data. Step SBc1 to Step SBc6 represent a process executed by the client electronic music apparatus 1 shown in FIG. 1 (hereinafter called "the client"), and Step SBs1 to Step SBs9 represent a process executed by the server electronic music apparatus 2 shown in FIG. 1 (hereinafter called "the server").

At Step SBs1, the server-side process is started, and the process proceeds to the next Step SBs2.

At Step SBs2, a target client of remote setting, remote file operation or the like is selected and a private IP address of the target client is acquired from, for example, a list stored in the external storage device 15 or the like. Then, the process proceeds to Step SBs3.

Further, the remote setting in this specification is, for example, when the client is an electronic musical instrument, a tone color setting, an effect setting, a MIDI related setting or the like. Also, the remote file operation is an operation of, for example, file or folder on the client such as creating new file or folder, copying, moving or removing.

At Step SBs3, a connection request is transmitted to the client having the private IP address acquired at Step SBs2. At the meantime, the server electronic music apparatus identifying information is transmitted together with the connection request. Then, the process proceeds to Step SBs4.

At Step SBs4, whether a display data is received from the client or not is judged. When the display data is received, that is, the access from the server is authorized by the client, the process proceeds to Step SBs6 as directed by an arrow marked "YES". When the display data is not received, that is, the notification of the refusal of the access is received, the process proceeds to Step SBs5, a message notifying the refusal of the access is displayed on the display 14 at Step SBs5, and the process proceeds to Step SBs9 to terminate the sever-side process.

At Step SBs6, a remote setting window or a remote file operation window is displayed on the display 14 in accordance with the display data received at Step SBs4. Then, the process proceeds to the next Step SBs7.

At Step SBs7, the remote setting or the remote file operation of the client is executed with reference to the remote setting window or the remote file operation window displayed on the display 14. That is, information such as various parameters are input in accordance with the remote setting window or the remote file operation window displayed on the display 14. Then, the process proceeds to the next Step SBs8.

At Step SBs8, the information such as the parameters, etc. input at Step SBs7 is transmitted to the client having the private IP address acquired from the list at Step SBs2. Then the process proceeds to Step SBs9 to terminate the sever-side process.

The client-side process is explained next. Each client electronic music apparatus 2 has a HTTP server function and transmits display data for various setting and file operation windows to the server electronic music apparatus 1 by executing the HTTP server function in accordance with the access from the server electronic music apparatus 1 when the server electronic music apparatus 1 sets up the client electronic music apparatus 2.

At Step SBc1, the client-side process is started, and the process proceeds to Step SBc2.

At Step SBc2, the connection request and the server electronic music apparatus identifying information transmitted from the server at Step SBs3 are received, and whether the access from the server has already been authorized or not is judged. That is, whether the received server electronic music apparatus identifying information is the same identifying information as that of the sever to which the access was authorized at Step SAc7 in FIG. 3 or not is judged. When the access has been already authorized, the process proceeds to Step SBc4 as directed by an arrow marked "YES". When the access has not been authorized yet, the process proceeds to Step SBc3 as directed by an arrow marked "NO".

At Step SBc3, the notification of the refusal of the access is transmitted to the server, and then the process proceeds to Step SBc6 to terminate the client-side process.

At Step SBc4, the display data for the setting window or the file operation window is transmitted to the server with making the transmitter IP address and the receiver IP address included in the connection request received at Step SBc2 respectively be a new receiver IP address and a new transmitter IP address. Then, the process proceeds to the next Step SBc5.

At Step SBc5, the information such as the parameters, etc. input at Step SBs7 and transmitted at Step SBs8 is received, and an internal setting or a file operation is executed in accordance with the received information. Then the process proceeds to Step SBc6 to terminate the client-side process.

FIG. 6 is a flow chart showing an IP address converting process according to the embodiment of the present invention. In the drawing, the broken lines represent data flows. On the left side of a one-point chain line, processes executed by the apparatuses on the LAN are depicted, and on the right side, a process executed by the apparatus on the WAN is depicted.

Step SCc1 to Step SCc4 represent a process executed by the client electronic music apparatus 2 (the client) shown in FIG. 1, and Step SCs1 to Step SCs4 represent a process executed by the server electronic music apparatus 1 (the server) shown in FIG. 1. Step SCo1 to Step SCo4 represent a process executed by the other computer shown in FIG. 1.

At first, the process executed by the client on the LAN is explained.

At Step SCc1, the client process is started, and the process proceeds to the next Step SCc2.

At Step SCc2, the client accesses to the other computer 5 with the private IP address assigned to the client itself as a transmitter IP address. A global IP address assigned to the other computer is designated to be a receiver IP address. Then, the process proceeds to the next Step SCc3.

At Step SCc3, a process corresponding to the access from the server later-described at Step SCs3 is carried out. The process here includes, for example, a download process of a music data such as an automatic performance data, etc., a download process of the control program, a displaying process of a Web page, etc. Then, the process proceeds to the next Step SCc4 to terminate the client process.

Next, the process executed by the server on the LAN is explained.

At Step SCs1, the server process is started, and the process proceeds to the next Step SCs2.

At Step SCs2, the transmitter IP address of the access of the client to the other computer 5 at Step SCc2 is converted to a global IP address. The sever accesses to the other computer 5 with the converted global IP address as a transmitter IP address. Then, the process proceeds to the next Step SCs3.

At Step SCs3, the receiver IP address of the access of the other computer 5 to the client at the later-described Step SCo3 is converted to the original private IP address converted at Step SCs2. Then, the server accesses to the client with the converted private IP address as the receiver IP address. Thereafter, the process proceeds to the next Step SCs4 to terminate the server process.

Finally, the process executed by the other computer 5 on the WAN is explained.

At Step SCo1, the other computer's process is started, and the process proceeds to the next Step SCo2.

At Step SCo2, a process corresponding to the access from the server at Step SCs2 is executed. Then, the process proceeds to the next Step SCo3.

At Step SCo3, the other computer 5 accesses to the client with the transmitter IP address of the access from the server at Step SCs2 as the receiver IP address. The global IP address set to be the receiver IP address is converted to the private IP address by the server at Step SCs3. Therefore, the other computer 5 and the client can communicate with each other. Thereafter, the process proceeds to the next Step SCo4 to terminate the other computer's process.

As described above, according to the embodiment of the present invention, the client electronic music apparatus transmits the inquiring request for the information about a network configuration such as an IP address, etc. to the server electronic music apparatus, the server electronic music apparatus assigns the private IP address to the client electronic music apparatus, and the client electronic music apparatus set up the information about a network configuration assigned by the server. That is, a user does not have to input the information about a network configuration such as an IP address, etc. manually. Therefore, even a user who is not familiar with a network configuration can easily set up a communication network by an electronic music apparatus.

In addition, the client electronic music apparatus transmits the electronic music apparatus identifying information together with the request for the information about a network configuration to the server electronic music apparatus and obtains the information about a network configuration upon an authorization based on the electronic music apparatus identifying information. Therefore, the authorized client electronic music apparatus can obtain the information about a network configuration because the server electronic music apparatus supplies the information about a network configuration only to the authorized client electronic music apparatus.

Further, according to the embodiment of the present invention, the server electronic music apparatus receives the inquiring request for the information about a network configuration from other electronic music apparatus, and supplies the information about a network configuration to the other electronic music apparatus in accordance with the request. Therefore, even if a user of the other electronic music apparatus is not familiar with a network configuration, the user can set up the network configuration easily.

Further, the server electronic music apparatus receives identifying information of the other electronic music apparatus together with the information about a network configuration, judges whether supplying the information about a network configuration is authorized or not in accordance with the identifying information, and supplies the information about a network configuration only to the authorized other electronic music apparatus.

Therefore, the server electronic music apparatus according to the embodiment of the present invention can prevent to supply the information about a network configuration mistakenly to an unauthorized or illegal other electronic music apparatus. Further, it is preferable that the information about a network configuration set to the above-described electronic music apparatus is a configuration (e.g., a private IP address) valid only within a specific communication network (e.g., LAN), and a configuration that can prevent an unauthorized access from an external communication network such as the Internet or the like.

When the electronic music apparatus connects to the external communication network, the configuration valid only within the specific communication network is converted to a configuration (e.g., a global IP address) valid in the external communication network. Therefore, the electronic music apparatus can communicate with an apparatus on the external communication network (WAN) while maintaining a security of the specific (internal) communication network (LAN).

Furthermore, according to the embodiment of the present invention, the server electronic music apparatus can set up various configurations of the client electronic music apparatus and operates files within the client electronic music apparatus. Therefore, when the client electronic music apparatus has no user interface, various settings and file operations can be executed from the server electronic music apparatus.

Also, the client electronic music apparatus authorizes an access from the server for a configuration of the client in accordance with the server electronic music apparatus identifying information received with the information about a network configuration, and only the server electronic music apparatus with that authorization can execute the remote setting or the remote file operation. Therefore, the setting whether the settings and the file operations from the server electronic music apparatus is authorized or not is easy to be configured, and an access from an unauthorized electronic music apparatus can be prevented.

Further, according to the embodiment of the present invention, authorization of a connection (an access) is determined in accordance with the electronic music apparatus identifying information that is unique for each electronic music apparatus, unlike using generally used MAC address that is unique for each communication interface, an authorized access using a removable communication interface can be prevented.

The embodiment may be realized by a commercially available general computer installed with the computer program and the like realizing the functions of the embodiment.

In such a case, the computer program and the like realizing the embodiment functions may be stored in a computer readable storage medium such as a CD-ROM and a floppy disc and supplied to users.

If the computer is connected to a communication network such as a LAN, the Internet and a telephone line, the computer program and various data may be supplied to the computer via the communication network.

The present invention has been described in connection with the preferred embodiments. The invention is not limited only to the above embodiments. It is apparent that various modifications, improvements, combinations, and the like can be made by those skilled in the art.

What are claimed are:

1. An electronic music apparatus, comprising:

a storage device that stores music data;

a music tone generator that generates a music tone in accordance with the music data stored in the storage device;

a transmitter that transmits an acquiring request for information about a network configuration to a server via a communication network;

a first receiver that receives the information about a network configuration from the server;

a setting device that sets up a network configuration of the communication network in accordance with the received information about a network configuration; and a second receiver that receives, via the server, music data from a computer that is connected to the server.

2. An electronic music apparatus according to claim 1, wherein the transmitter further transmits identifying information for identifying the electronic music apparatus with the acquiring request for the information about a network configuration, and wherein the first receiver receives the information about a network configuration upon an authorization based on the identifying information to connect to the server.

3. An electronic music apparatus operatively coupled to a computer, said electronic music apparatus comprising:

a receiver that receives an acquiring request for information about a network configuration from a client via a communication network;

a generating device that generates information about a network configuration for supplying to the client in accordance with the received acquiring request for the information about a network configuration;

a first transmitter that transmits the generated information about a network configuration to the client; and a second transmitter that transmits music data from the computer to the client.

4. An electronic music apparatus according to claim 3, further comprising an authorizing device that authorizes or rejects an access from the client based on identifying information for identifying the client, wherein the receiver receives the identifying information with the acquiring request, and wherein the transmitter transmits the generated information about a network configuration to the client when the authorizing device authorizes the access from the client.

5. An electronic music apparatus, comprising:

a musical tone generator for generating a musical tone;

a first receiver that receives identifying information for identifying a server from the server via a communication network;

an authorizing device that authorizes or rejects an access from the server based on the identifying information for identifying the server;

a second receiver that receives, from the server, operating information containing setting parameters for generating a musical tone using the musical tone generator when the authorizing device authorizes the access from the server; and an execution device for setting the parameters of the musical tone generator in accordance with the received operating information.

6. A program which computer can executes for realizing a electronic music process, the electronic music process comprising the instructions for:

generating a music tone in accordance with the music data stored in a storage device;

transmitting an acquiring request for information about a network configuration to a server via a communication network;

receiving the information about a network configuration from the server;

setting up a network configuration of the communication network in accordance with the received information about a network configuration; and receiving, via the server, music data from a computer that is connected to the server.

7. A program which an electronic music apparatus can executes for realizing a electronic music process, the electronic music process comprising the instructions for:

receiving an acquiring request for information about a network configuration from a client via a communication network;

generating information about a network configuration for supplying to the client in accordance with the received acquiring request for the information about a network configuration;

transmitting the generated information about a network configuration to the client; and transmitting music data, from a computer operatively coupled to the electronic music apparatus, to the client that the network configuration had been set.

8. A program which computer can executes for realizing a electronic music process, the electronic music process comprising the instructions for:

receiving identifying information for identifying a server from the server via a communication network;

authorizing or rejecting an access from the server based on the identifying information for identifying the server;

receiving, from the server, operating information containing setting parameters corresponding to a musical tone to be generated when the authorizing device authorizes the access from the server;

executing the setting of the electronic music instrument in accordance with the received operating information; and generating the musical tone.

* * * * *